US011649665B1

(12) United States Patent
Earnest

(10) Patent No.: US 11,649,665 B1
(45) Date of Patent: May 16, 2023

(54) OVERHEAD GARAGE DOOR TRIM SYSTEM AND METHOD OF INSTALLATION AND USE

(71) Applicant: William Keith Earnest, Louisville, TN (US)

(72) Inventor: William Keith Earnest, Louisville, TN (US)

(73) Assignee: GRIDZ LLC, Knoxville, TN (US)

( * ) Notice: Subject to any disclaimer, the term of this patent is extended or adjusted under 35 U.S.C. 154(b) by 0 days.

(21) Appl. No.: 17/866,426

(22) Filed: Jul. 15, 2022

Related U.S. Application Data

(60) Provisional application No. 63/311,431, filed on May 11, 2022.

(51) Int. Cl.
*E06B 3/70* (2006.01)

(52) U.S. Cl.
CPC .... *E06B 3/7001* (2013.01); *E06B 2003/7044* (2013.01)

(58) Field of Classification Search
CPC ..... E06B 3/7001; E06B 3/7003; E06B 2003/7044; E06B 2003/7011
See application file for complete search history.

(56) References Cited

U.S. PATENT DOCUMENTS 741,524 A * 10/1903 Miller ..... E04F 13/0803 52/506.05
2,928,462 A * 3/1960 Neisewander ..... E06B 3/485 160/229.1
3,611,664 A * 10/1971 Barbera ..... E04F 13/0821 52/778
5,598,667 A * 2/1997 Dykes ..... E06B 3/7001 52/316
5,943,803 A * 8/1999 Zinbarg ..... E06B 3/485 40/594
6,026,886 A * 2/2000 Diamond-Martinez ..... E06B 3/7001 160/369
6,131,345 A * 10/2000 Pelusio ..... E06B 3/7001 52/204.6
6,148,896 A * 11/2000 Pinto ..... E06B 3/485 49/501
6,446,695 B1 9/2002 Forsland
(Continued)

FOREIGN PATENT DOCUMENTS

DE 29621236 U1 7/1997

*Primary Examiner* — Beth A Stephan
(74) *Attorney, Agent, or Firm* — Master Key IP, LLP; Jeromye V. Sartain

(57) ABSTRACT

An overhead garage door trim system includes a plurality of trim pieces and at least one panel. Each trim piece has a trim piece inner surface and at least one trim piece undercut formed in the trim piece inner surface along a trim piece inner edge, the trim pieces configured to be installed spaced-apart along at least one section of the overhead garage door with respective trim piece inner edges opposed. And the at least one panel is configured to be positioned on the at least one section of the overhead garage door and secured thereon by the plurality of trim pieces, each panel having edges configured to be secured within opposite trim piece undercuts of spaced-apart trim pieces. In use the at least one panel is clamped and retained on the overhead garage door so as to float within the respective trim piece undercuts.

24 Claims, 8 Drawing Sheets

(56) References Cited

U.S. PATENT DOCUMENTS

| | | | | |
|---|---|---|---|---|
| 6,572,238 | B1 * | 6/2003 | Johnson | F21V 33/006 362/147 |
| 6,586,085 | B1 | 7/2003 | Jella | |
| 7,383,872 | B1 * | 6/2008 | Jella | E06B 3/7001 52/717.01 |
| 7,431,068 | B1 * | 10/2008 | Jella | E06B 3/7001 160/236 |
| 7,484,286 | B2 | 2/2009 | Fowler | |
| 7,900,682 | B2 * | 3/2011 | Calvino, Jr. | E06B 3/485 52/407.3 |
| 8,839,582 | B2 * | 9/2014 | Aboukhalil | E04F 19/062 52/460 |
| 8,999,478 | B1 * | 4/2015 | Medlen | B32B 21/14 52/588.1 |
| 9,359,809 | B2 * | 6/2016 | Richardson | E06B 3/485 |
| 9,567,794 | B2 | 2/2017 | Medlen | |
| 10,413,106 | B1 * | 9/2019 | Valeriano | A47G 29/141 |
| 2005/0194106 | A1 | 9/2005 | Scales | |
| 2006/0027342 | A1 | 2/2006 | Maher | |
| 2006/0162875 | A1 | 7/2006 | Magill et al. | |
| 2009/0223131 | A1 | 9/2009 | Wiese | |
| 2012/0272601 | A1 * | 11/2012 | Mouskis | E06B 3/7003 29/428 |
| 2013/0097939 | A1 * | 4/2013 | Blume | E06B 3/485 49/506 |
| 2015/0184448 | A1 * | 7/2015 | Medlen | B32B 21/08 160/215 |
| 2018/0044973 | A1 * | 2/2018 | Barnes | E06B 3/7001 |
| 2018/0058138 | A1 * | 3/2018 | Binder | E06B 3/30 |
| 2018/0142514 | A1 * | 5/2018 | Alvarez | E06B 3/5454 |
| 2021/0246713 | A1 * | 8/2021 | Kozisek | E06B 3/2632 |

* cited by examiner

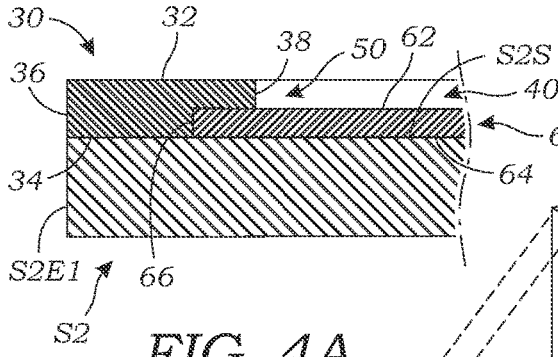
FIG. 4A
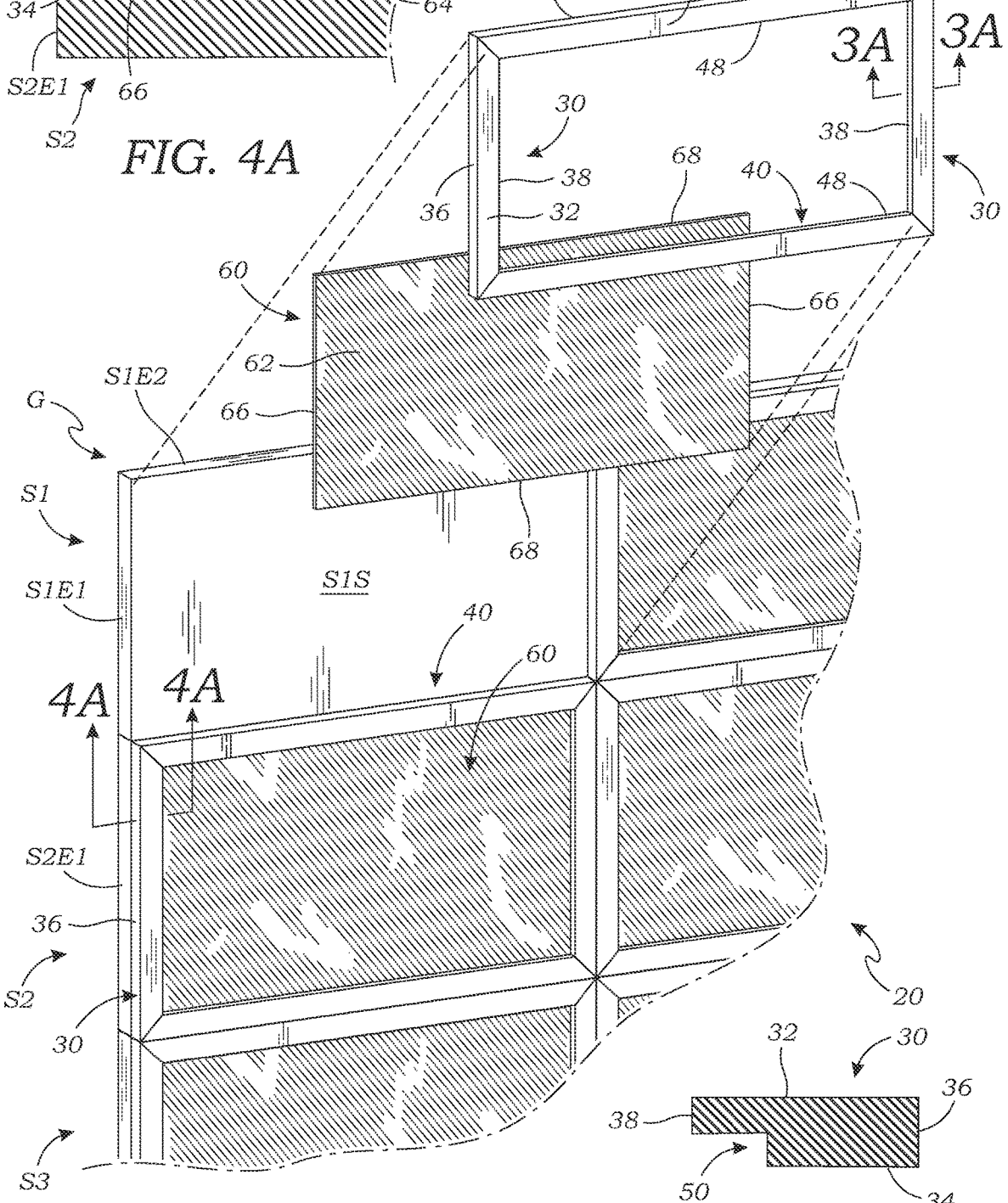
FIG. 2A
FIG. 3A

OVERHEAD GARAGE DOOR TRIM SYSTEM AND METHOD OF INSTALLATION AND USE

RELATED APPLICATIONS

This non-provisional patent application claims priority pursuant to 35 U.S.C. § 119(e) to and is entitled to the filing date of U.S. Provisional Patent Application Ser. No. 63/311,431 filed Feb. 17, 2022, though accorded a filing date of May 11, 2022, and entitled "Garage Door Design." The contents of the aforementioned application are incorporated herein by reference.

BACKGROUND

The subject of this patent application relates generally to facades for overhead garage doors, and more particularly to trim pieces and systems configured for selectively securing a variety of panels to an overhead garage door exterior.

The following description includes information that may be useful in understanding the present invention. It is not an admission that any of the information provided herein is prior art or relevant to the presently claimed invention, or that any publication specifically or implicitly referenced is prior art.

Applicant(s) hereby incorporate herein by reference any and all patents and published patent applications cited or referred to in this application, to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

By way of background, overhead garage doors are widely known and used as having parallel horizontal sections that are interconnected by hinges and each have opposite rollers that operate in corresponding tracks mounted at the left and right sides of the garage structure adjacent the opening, each such track having a vertical portion that is substantially parallel to the front of the garage or building and a horizontal portion that is parallel to the floor and/or roof or ceiling of the garage or building with a curved portion of track therebetween, whereby the garage door can be operated whether manually or via a garage door motor assembly so as to shift between a substantially vertical closed position and a substantially horizontal open position. The typical sizes of such garage openings and thus such overhead garage doors are either eight feet (8 ft.) (single-car) or sixteen feet (16 ft.) (two-car) in width and approximately seven feet (7 ft.) in height made up of either three horizontal hinged door sections of approximately twenty-eight inches (28 in.) in height each or four horizontal hinged door sections of approximately twenty-one inches (21 in.) in height each.

Each horizontal section of the typical residential overhead garage door comprises a stamped steel exterior on a steel or aluminum frame structure, with or without a foam or other such core for insulative and sound dampening properties. As such, the exterior surface of the garage door and thus the overall appearance of the door is generally limited to what can be stamped or formed in the steel skin, including wood grain features, and that without compromising the structural integrity of the door. And yet due to the visibility and even prominence of residential garage doors in today's home designs and the desire to enhance the look or "curb appeal" of the home, a variety of door designs are highly sought after, from vintage or nostalgic wood "carriage house" style doors to modern aluminum "full-view" doors having glass panels throughout the door sections and numerous other styles from various manufacturers suited to various residential architectural designs.

Accordingly, in current overhead garage door construction, manufacturers such as Wayne Dalton, Haas Door, Overhead Door, Clopay, and others, in the interest of providing a variety of door alternatives to their customers, have adopted a discontinuous production model based on a foundational or underlying conventional steel door structure with overlays or layers built or adhered onto the exterior skin of the door to create the desired and even built-to-order door appearance, including style, color and texture, and window configuration and placement. The decorative overlays are usually polyurethane, polystyrene, or other composite material glued onto the exterior door skin. Standard glass, insulated glass, and polycarbonate windows, with optional glazing or other designs, as appropriate, are secured in door sections via flush or raised panels, in either case requiring corresponding cut-outs in the steel door skin. While such designs and related manufacturing processes are functional, there are numerous drawbacks in terms of production process and cost, starting with the amount of glue required and related thermal expansion issues between materials when all are glued on at one ambient temperature and then experience a range of temperatures during normal use. Such door construction with overlays also presents particular challenges associated with window placement due to the need for cut-outs in the underlying door skin, thus increasing cost and complexity particularly in offering customization and variety of window styles and locations on the door.

An early after-market proposal for faux or decorative artificial windows in otherwise conventional steel overhead garage doors is shown in U.S. Pat. No. 6,131,345 to Pelusio granted on Oct. 17, 2000 and directed to a garage door window facade constructed from a flat panel having a plurality of apertures shaped to resemble small window openings. In a first embodiment, a dark-colored backing is positioned behind the flat panel and is visible through the apertures to create the illusion of a window. In a second embodiment, a layer of transparent or translucent material is sandwiched between the flat panel and the dark-colored backing to give an enhanced appearance of a window opening. The assembly is rigidly secured to a standard garage door by bolts, screws, adhesive, or the like to give the illusion that the garage door has windows. The apparatus does not protrude far from the exterior surface of the garage door so that the apparatus does not interfere with the opening or closing of the garage door. An aesthetic molding may be positioned around the peripheral edges of the assembly for framing purposes, or the flat panel may be provided with built-in molding.

The more modern aluminum "full-view" doors may be desirable to many homeowners in appearance, but by having glass panels throughout the door sections and thus of necessity not currently constructed on the typical steel door base structure, there are a number of drawbacks to these aluminum doors as well, including cost and difficulty in both manufacture and installation and in maintenance (more likely or easily damaged, as by being impacted or in high winds) and reduced privacy and insulative value (or increased energy loss). Fundamentally, if a homeowner desired the look of an aluminum "full-view" door, in addition to the foregoing shortcomings, the homeowner would have to go to the expense of removing the existing door and purchasing and installing a new aluminum "full-view" door at typically a much higher cost (on the order of two to three times the cost of a standard steel door or more), as there currently are no known effective means for modifying the appearance of a standard steel door to look like an aluminum "full-view" door.

And specifically in terms of "carriage house" style overhead garage doors, a number of such door configurations have been proposed over the years. First, some "carriage house" overhead garage doors are purpose-built of wood or wood-covered or -inlaid horizontal sections and thus achieve the desired overall appearance, but such doors have numerous drawbacks particularly in terms of cost and weight but also in maintenance, with wood of course being susceptible to the "elements" moreso than metal, composites, and other modern building materials. In U.S. Pat. No. 7,431,068 to Jella granted on Oct. 7, 2008 and assigned to First United Door Technologies in Tempe, Ariz., there is proposed a "carriage house replica garage door" aimed at solving some of the above-noted problems associated with more traditional wood "carriage house" style overhead garage doors as by having a sheet metal substructure and faux-wood foam trim boards adhered or fastened to the sheet metal substructure, more akin to the garage door overlay decorative panels employed by numerous manufacturers as described above, but fundamentally the Jella construction is relatively costly and complex and has attendant downsides again based on each multiple-layer overlay piece being separately glued to the door substructure (skin) or to an adjacent panel piece to construct the finished door appearance, sometimes having as many as five layers all glued together. An even earlier proposal regarding a "carriage house" façade on an otherwise standard overhead garage door as disclosed in U.S. Pat. No. 6,148,896 to Pinto granted on Nov. 1, 2000 entails building a single overlay system onto a door spanning all sections and thereafter cutting the overlay panels along the adjacent section edges or joints to allow the door to then articulate in use, which has even further disadvantages in installation and assembly. Other options again include manufactured steel skin garage doors (sections) having wood grain texture formed in the steel skin itself or otherwise formed on or applied to the surface of the steel skin, but again such may not have the desired authentic-looking "carriage house" door appearance along with potentially being cost-prohibitive.

More recently, U.S. Pat. Nos. 8,999,478 and 9,567,794 to Medlen granted on Apr. 7, 2015 and Feb. 14, 2017, respectively, and assigned to Garageskins, Inc. in Albany, Oreg. disclose a panel overlay system for embellishing an existing metal multi-panel articulating overhead garage door to provide a "carriage house" overhead garage door appearance on an otherwise conventional steel or other metal door. Such panels include multiple permanently assembled layers or features as a complete or unitary panel that is magnetically attached to the underlying steel door section as desired via a plurality of magnets glued into inwardly-opening blind bores formed in the underlayment or backing layer of the overlay panel. While such design allows for modification of an existing steel overhead garage door even in the field or as already installed, such panels also have numerous drawbacks in installation and use, starting with aligning or positioning the panels while having sufficient magnets (strength and/or number) to secure the panels to the door acceptably. And even once so installed, such panels may be prone to movement during use of the door and due to weather, especially as water may get behind the panels and freeze and thereby even cause the panels to come off.

What is needed and has heretofore been unavailable is a system and method for more easily, efficiently, and effectively installing decorative overlay features on overhead garage door exteriors, particularly in production, with less cost and material waste and improved functionality and more variability in the finished door appearance.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing an overhead garage door trim system for installation on an overhead garage door having a plurality of sections. In at least one embodiment, the overhead garage door trim system includes a plurality of trim pieces, each trim piece having a trim piece inner surface and at least one trim piece undercut formed in the trim piece inner surface along a trim piece inner edge, the trim pieces configured to be installed spaced-apart along at least one section of the overhead garage door with respective trim piece inner edges opposed, and further includes at least one panel configured to be positioned on the at least one section of the overhead garage door and secured thereon by the plurality of trim pieces, each panel having edges configured to be secured within opposite trim piece undercuts of spaced-apart trim pieces, wherein in use the at least one panel is clamped and retained on the overhead garage door so as to float within the respective trim piece undercuts.

Other objects, features, and advantages of aspects of the present invention will become more apparent from the following detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings:

FIG. 2A is an enlarged partial exploded perspective view thereof, in accordance with at least one embodiment;

FIG. 3A is an enlarged cross-sectional view of a trim piece thereof taken from line 3A-3A in FIG. 2A, in accordance with at least one embodiment;

FIG. 4A is an enlarged cross-sectional view of a trim piece and panel assembly thereof taken from line 4A-4A in FIG. 2A, in accordance with at least one embodiment;

Figure 1:
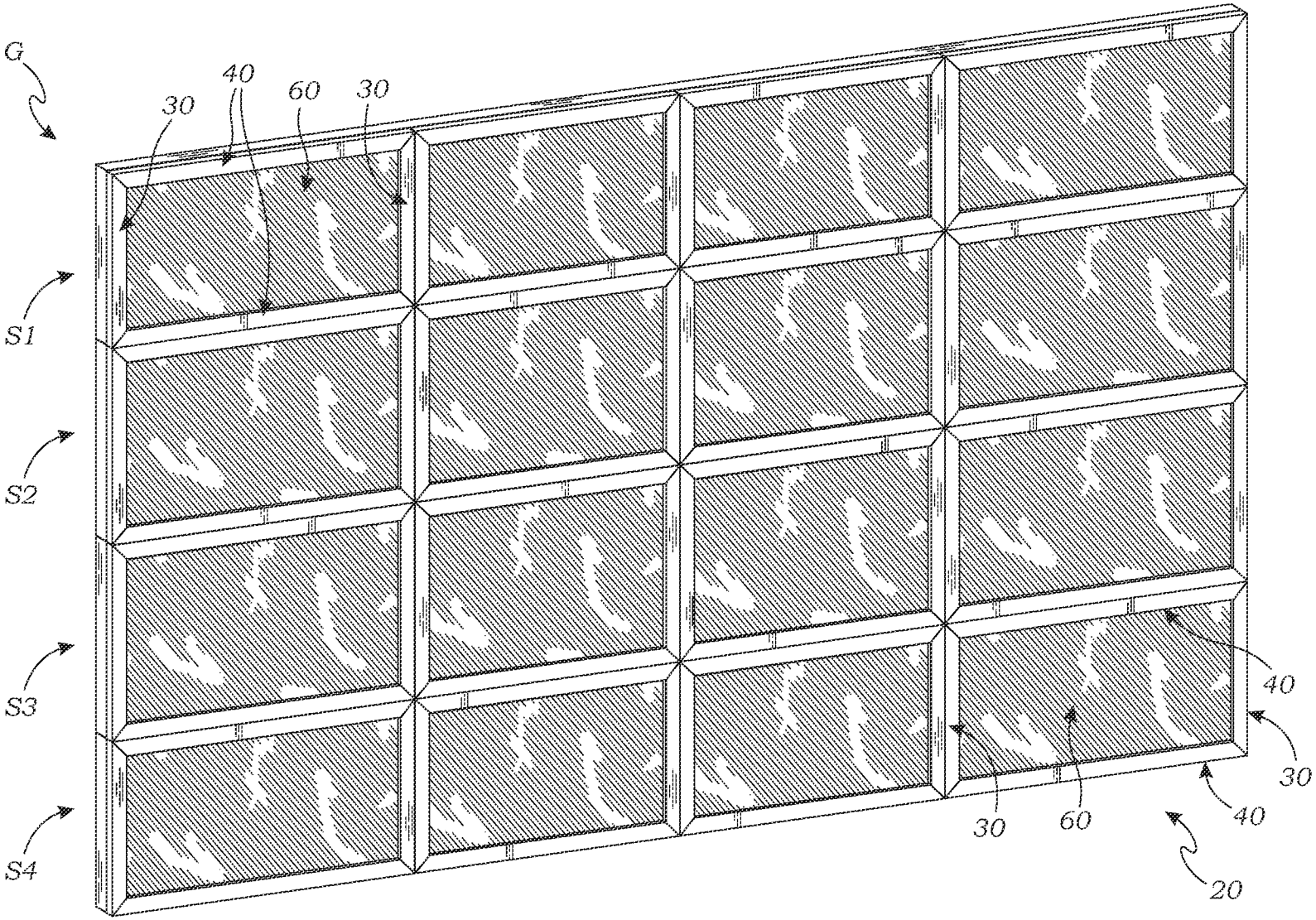
FIG. 1 is a perspective view of an exemplary overhead garage door trim system as installed on a two-car four-section garage door, in accordance with at least one embodiment.
Figure 4B:
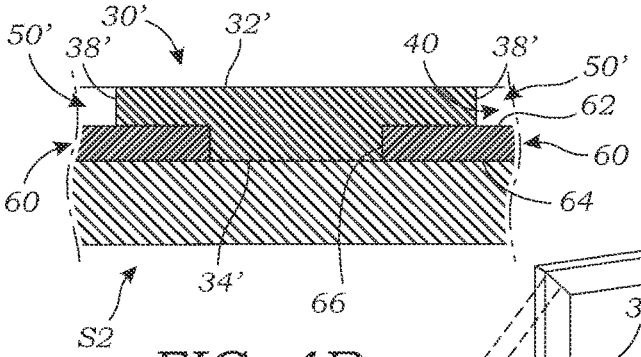
FIG. 4B is an enlarged cross-sectional view of a trim piece and two-panel assembly thereof taken from line 4B-4B in FIG. 2B, in accordance with at least one embodiment.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments. More generally, those skilled in the art will appreciate that the drawings are schematic in nature and are not to be taken literally or to scale in terms of material configurations, sizes, thicknesses, and other attributes of a system according to aspects of the present invention and its components or features unless specifically set forth herein.

DETAILED DESCRIPTION

The following discussion provides many exemplary embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

While the inventive subject matter is susceptible of various modifications and alternative embodiments, certain illustrated embodiments thereof are shown in the drawings and will be described below in detail. It should be understood, however, that there is no intention to limit the invention to any specific form disclosed, but on the contrary, the inventive subject matter is to cover all modifications, alternative embodiments, and equivalents falling within the scope of any appended claims.

Figure 2B:
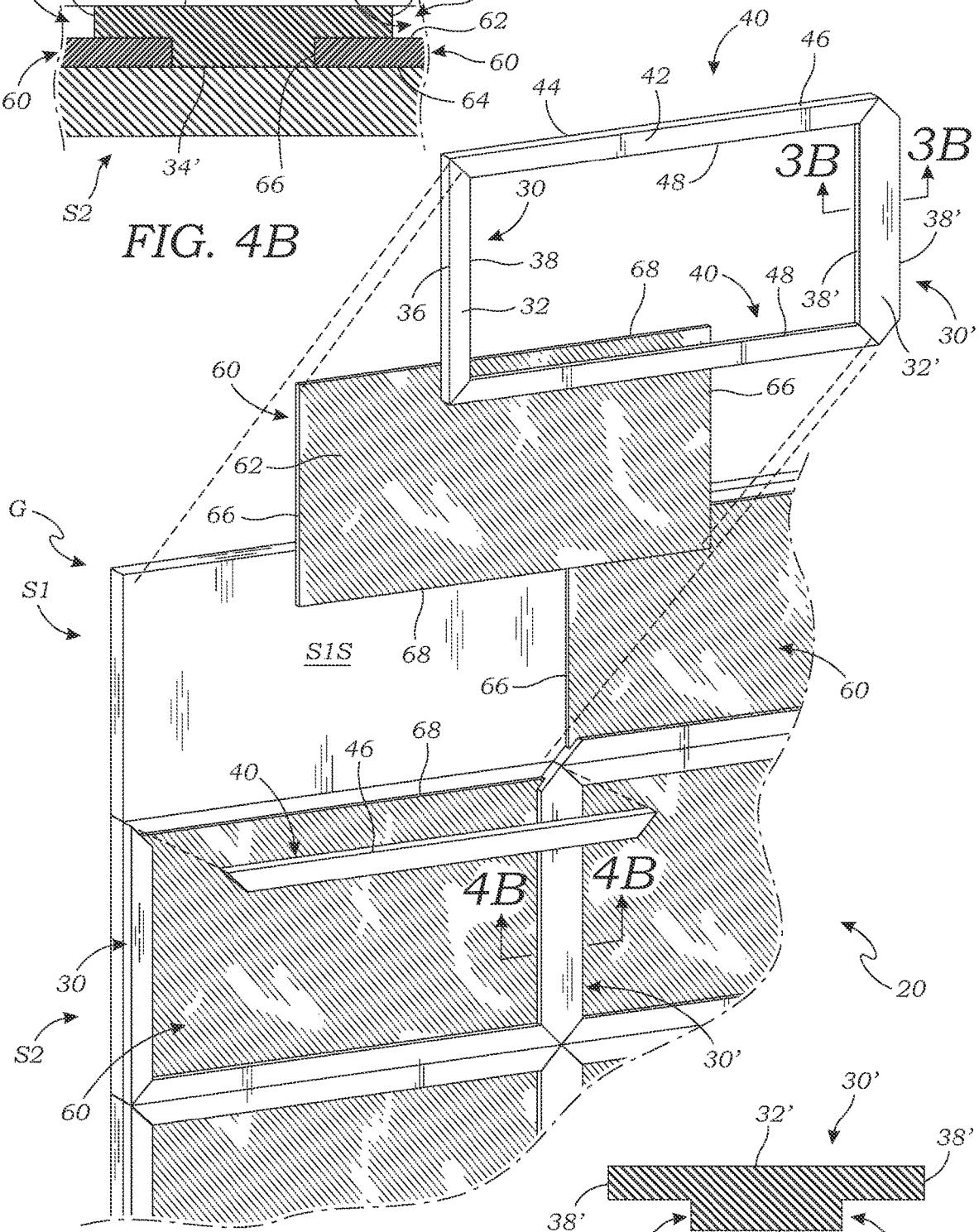
FIG. 2B is an enlarged partial exploded perspective view of an alternative exemplary trim system, in accordance with at least one embodiment.
Figure 3B:
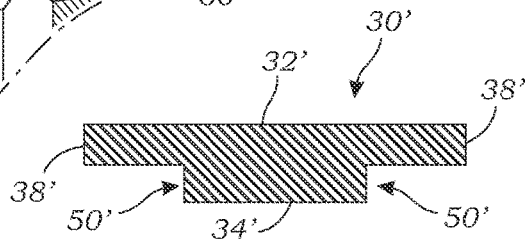
FIG. 3B is an enlarged cross-sectional view of a trim piece thereof taken from line 3B-3B in FIG. 2B, in accordance with at least one embodiment.

Turning now to FIG. 1, there is shown a perspective view of an exemplary embodiment of an overhead garage door trim system 20 according to aspects of the present invention as installed on an illustrative garage door G. The system 20 comprises, in the exemplary embodiment, a plurality of selectively abutting vertical trim pieces 30 and horizontal trim pieces 40 each having along the underside of its inner edge 38, 48 (FIG. 2A) at least one lengthwise undercut 50 (FIG. 3A) configured to receive a perimeter edge 66, 68 (FIG. 2A) of an underlying overlay panel 60 that is thereby clamped or retained on or adjacent to the garage door G, and specifically a section S1, S2, S3, S4 thereof, while the panel 60 itself is not mounted but instead floating within opposed vertical and horizontal trim pieces 30, 40 as retained by their respective undercuts 50. At a high level, it will be appreciated by those skilled in the art that such means for retaining decorative overlay panels 60 on a garage door G façade offers material and cost reduction and versatility in production and use, as by not gluing or otherwise mounting the panels 60 having relatively larger surface area but instead only mounting the clamping trim pieces 30, 40 as herein described in more detail below, including addressing thermal expansion effects and providing other benefits. More generally, those skilled in the art will appreciate that the particular trim system 20 of FIG. 1 is merely illustrative of features and aspects of the present invention and non-limiting, as will be appreciated with reference to the alternative exemplary embodiments of FIGS. 5-12 discussed further below. Furthermore, while the exemplary context is overhead garage doors, particularly residential overhead garage doors, it will be appreciated that the invention is not so limited and that aspects of the present invention may indeed be employed in conjunction with a variety of other residential and commercial doors and building facades, including but not limited to entry doors and windows. And once more, the drawings are schematic in nature and are not to be taken literally or to scale in terms of material configurations, sizes, thicknesses, and other attributes of a system 20 according to aspects of the present invention and its components or features. It is also noted that relative terms used throughout such as "vertical", "horizontal", "top", "bottom", "first" and "second" are not to be taken literally but are simply for ease of reference or relative orientation, particularly in connection with a typically-installed overhead garage door G that is substantially vertical and has a top that is furthest from the ground and a bottom that is closest to the ground when closed. Relatedly, while those skilled in the art will appreciate that in the industry or per standard industry nomenclature overhead garage door sections are typically numbered or referenced from the bottom up, such that the lowest section would be the "first" section and so on, for convenience herein relative to the description and drawings, the garage door sections S1, S2, S3, S4 are referenced or numbered instead from the top down, with the illustrative overhead garage door G having four sections identified as the first through fourth sections S1, S2, S3, S4. Furthermore, it will be appreciated by those skilled in the art that a wide variety of overhead door configurations are possible or may be employed, whether now known or later developed, including greater or fewer sections, such that the exemplary four-section overhead garage door G shown and described is merely illustrative and non-limiting.

With continued reference to FIG. 1 and now also FIGS. 2A-4A, it can be seen that in the exemplary embodiment each panel 60 is secured by four surrounding trim pieces 30, 40 along its edges 66, 68 as by nesting each panel edge 66, 68 within the respective trim piece undercut 50 and securing each trim piece 30, 40 to the underlying garage door G, specifically the outer surface SIS of the top or first section S1 of the garage door G as shown in the exploded view of FIG. 2A. In more detail, the illustrative panel 60 is a rectangular piece of glass, plexiglass, polycarbonate, acrylic, or the like having an outer surface 62 and an opposite inner surface 64 defining a panel thickness and having a perimeter defined by opposite respective vertical edges 66 and horizontal edges 68, with the overall perimeter or dimensions of the panel 60 being selected as to the width based on the overall width of the door G and the number of panels 60 (e.g., rectangular vs. square) desired along the width of each section S1, S2, S3, S4 and as to the height based on the height of each door section S1, S2, S3, S4, dictated by the overall height of the garage door G (e.g., 7 feet or 8 feet) and the number of sections in the door G (e.g., 3 or 4), and further allowing for the overlying trim pieces 30, 40 and the depth of their undercuts 50 so as to leave a perimeter portion around each panel 60 for mounting the trim pieces 30, 40 to the underlying door surface SIS about and adjacent to the panel 60 while clamping or retaining the perimeter of the panel 60 within the trim piece undercuts 50. Further, the illustrative trim pieces 30, 40 are rectangular elongated strips of material having a substantially rectangular profile or cross-section defined by opposite respective outer surfaces 32, 42 and inner surfaces 34, 44 and opposite respective outer edges 36, 46 and inner edges 38, 48 and being of appropriate length such that the vertical trim pieces 30 run along the vertical edges 66 of the panel 60 and the horizontal trim pieces 40 run along the horizontal edges 68 of the panel 60, in the exemplary embodiment each such trim piece 30, 40 having angle-cut ends along essentially forty-five degrees (45°) for respective abutment, such trim pieces 30, 40 also having an appropriate thickness as defined by the respective outer and inner surfaces 32, 34, 42, 44 to allow for a width or thickness of its undercut 50 to accommodate the panel 60 thickness—in the exemplary embodiment the width or thickness of the undercut 50 and the thickness of the panel 60 are nominally on the order of one sixteenth inch to one eighth inch (1/16 in. to 1/8 in.) while the overall thickness of the trim pieces 30, 40 is on the order of one quarter inch to one half inch (1/4 in. to 1/2 in.) and the overall width is on the order of two to three inches (2 in. to 3 in.), with the corresponding depth of the undercut 50 being on the order of one quarter inch to three quarter inch (1/4 in. to 3/4 in.), though it will again be appreciated that a variety of materials and sizes or thicknesses and related component geometries are possible in a trim system 20 according to aspects of the present invention without departing from its spirit and scope. It will also be appreciated that while in the exploded view of FIG. 2A the four trim pieces 30, 40 are shown as abutted even as separated from the panel 60 and the underlying door section S1, each such trim piece 30, 40 may also be separately assembled onto the door G versus being a pre-assembled frame as shown illustratively.

Referring still to FIGS. 1-4A, during production or assembly of an overhead garage door trim system 20 according to aspects of the present invention, each panel 60 is simply positioned on or adjacent to the garage door G, specifically an appropriate location on a section surface SIS thereof, and the respective trim pieces 30, 40 are installed about the panel 60 such that the undercut 50 of the left vertical trim piece 30 is substantially adjacent to both the left vertical edge 66 and outer surface 62 of the panel 60 and the left vertical trim piece inner edge 38 thus overlies the left vertical edge 66 and outer surface 62 of the panel 60, the undercut 50 of the top horizontal trim piece 40 is substantially adjacent to both the top horizontal edge 68 and outer surface 62 of the panel 60 and the top horizontal trim piece inner edge 48 thus overlies the top horizontal edge 68 and outer surface 62 of the panel 60, the undercut 50 of the right vertical trim piece 30 is substantially adjacent to both the right vertical edge 66 and outer surface 62 of the panel 60 and the right vertical trim piece inner edge 38 thus overlies the right vertical edge 66 and outer surface 62 of the panel 60, and the undercut 50 of the bottom horizontal trim piece 40 is substantially adjacent to both the bottom horizontal edge 68 and outer surface 62 of the panel 60 and the bottom horizontal trim piece inner edge 48 thus overlies the bottom horizontal edge 68 and outer surface 62 of the panel 60, thereby securing the panel 60 on the door G face without actually mounting or adhering the panel 60, it instead essentially "floating" within the frame of clamping trim pieces 30, 40 thereabout. Once more, those skilled in the art will appreciate that such assembly technique allows for readily customizing the combination of trim pieces 30, 40 and panels 60 on a particular overhead garage door G to achieve a desired overall appearance and reduces the amount of labor and materials in assembly, particularly regarding the fasteners for the trim pieces 30, 40, such as for example the amount of glue needed to install the overlay trim system 20. In an exemplary embodiment, the trim pieces 30, 40 are glued or bonded to the underlying garage door surface SIS, though it will be appreciated that any appropriate fastening system or device now known or later developed and whether temporary or permanent may be employed. As best seen in the enlarged cross-sectional views of FIGS. 3A and 4A, then, even with the undercut 50 formed in the trim piece 30 at the intersection of its inner surface 34 and inner edge 38, or basically along the lengthwise inner edge 38, sufficient material or a sufficient portion of the inner surface 34 remains for installing, fastening, or otherwise mounting the trim piece 30 on the garage door surface SIS. Where the trim pieces 30, 40 are glued or bonded, while the inner surface 34 is shown as smooth or flat, it will be appreciated that grooves or channels, notches, reliefs, roughing or texturing, or other such surface feature(s) of the trim piece inner surface 34 may be employed to facilitate such bonding. Notably, while the outer surface 62 and left vertical edge 66 of the panel 60 are shown in FIG. 4A as substantially abutting the undercut 50, it will be appreciated that such is not necessary and a gap can be and preferably would be provided therebetween, or between all such panel edges 66, 68 and trim piece undercuts 50, to account both for tolerance accommodation in assembly and for thermal expansion and contraction of the components in normal use in the elements such as seasonal temperature variations, rain, and wind without compromising the integrity of the installation of the overlay trim system 20 on the underlying garage door G, as again by having the panel 60 "float" within the adjacent frame of trim pieces 30, 40, a gap of even one thirty-second inch (1/32 in.) between the panel edges 66, 68 and the trim piece undercuts 50 generally being sufficient, though again may vary depending on the materials and overall component geometries and other factors. It will be appreciated that templates, jigs, fixtures, or the like may be provided in conjunction with laying down and assembling the panels 60 and trim pieces 30, 40 on a door G for relatively rapid and repeatable assembly.

Briefly, as shown in FIGS. 2B-4B, an alternative exemplary trim system 20 according to aspects of the present invention involves interior or non-edge vertical trim pieces 30' that are effectively double-width and so configured to accommodate two adjacent underlying panels 60, one on each side. Each such alternative non-edge vertical trim piece 30' is thus formed on its opposite inner edges 38' with an undercut 50' so as to have a somewhat "T-shaped" cross-section, there then not being an outer edge 36 as with the single-width trim pieces 30, 40 of FIGS. 1-4A. Such double-width vertical trim piece 30' would otherwise be mounted on the underlying garage door G employing any appropriate technique now known or later developed in much the same way as the exemplary single-width trim piece 30 so as to here secure opposed vertical edges 66 of adjacent panels 60 within the respective undercuts 50'. Those skilled in the art will appreciate that the alternative non-edge double-width vertical trim piece 30' thus accomplishes with one component what was with two separate components in the first exemplary embodiment, thereby reducing the number of parts and assembly steps proportionately. Even so, it will be appreciated that the same approach cannot be taken with the horizontal trim pieces 40 as they straddle the break or joint between articulating sections S1, S2, S3, S4 of the exemplary conventional overhead garage door G.

Figure 5:
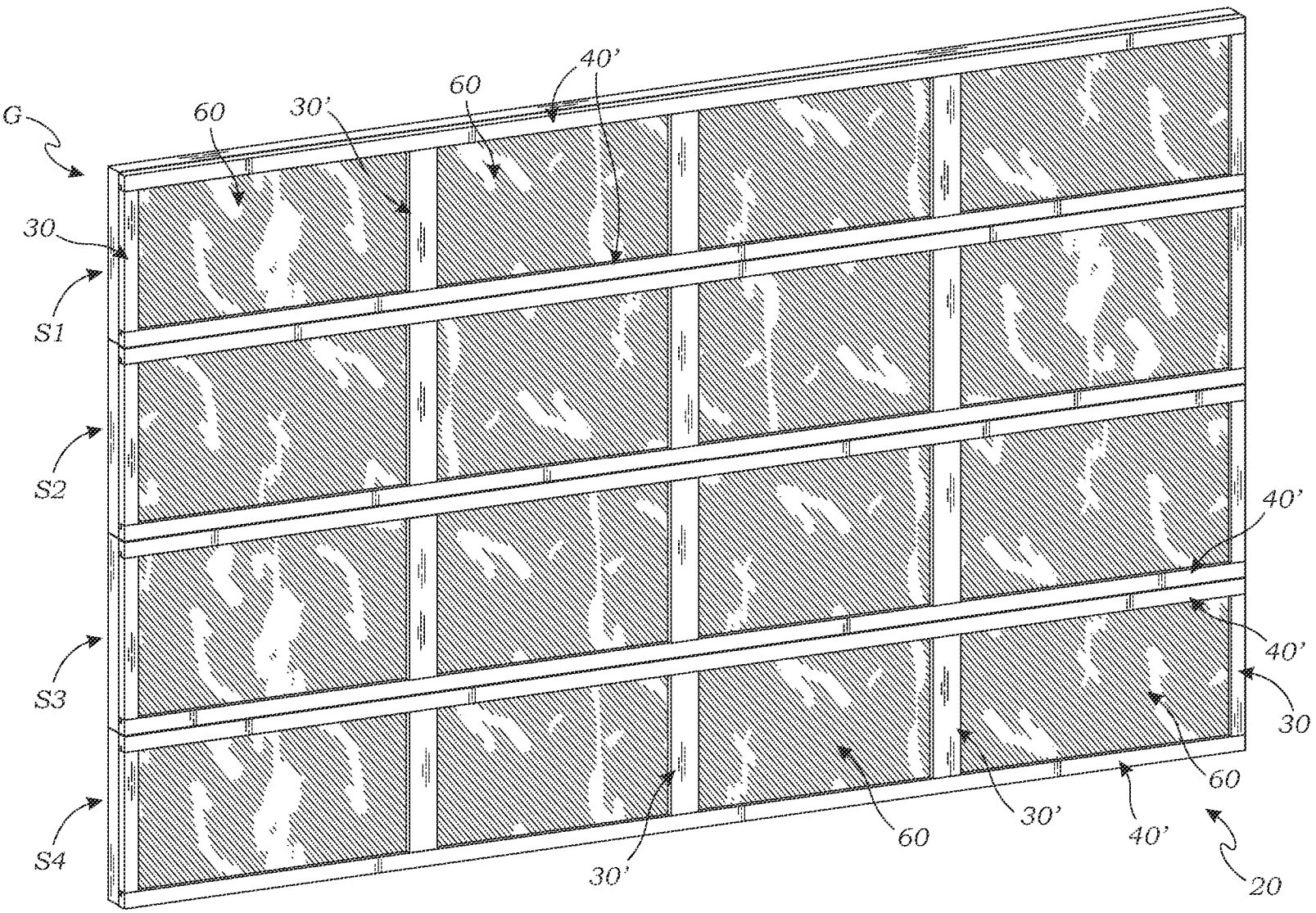
FIG. 5 is a perspective view of a further alternative exemplary overhead garage door trim system as installed on a two-car four-section garage door, in accordance with at least one embodiment.

And in the perspective view of FIG. 5, there is shown a further alternative exemplary trim system 20 according to aspects of the present invention that involves not only the alternative non-edge double-width vertical trim pieces 30' but also alternative continuous horizontal trim pieces 40' that span the full width of the garage door G. Accordingly, as shown, each of the vertical trim pieces 30, 30' is formed having square-cut or ninety-degree) (90° ends for respective abutment with the inner edges 48 of the widthwise horizontal trim pieces 40'. In forming the overall trim system 20 on the door G, or more precisely each door section S1, S2, S3, S4, the various vertical and horizontal trim pieces 30, 30', 40' would otherwise again be installed so as to trap or clamp the respective panels 60 employing any appropriate technique now known or later developed in much the same way as the exemplary trim pieces 30, 40 of the embodiments of FIGS. 1-4B. And those skilled in the art will once more appreciate that by reducing the total number of parts in the system 20, here by employing single widthwise horizontal trim pieces 40' at the top and bottom of each door section S1, S2, S3, S4 along with again employing double-width interior vertical trim pieces 30', the total number of components and thus assembly steps is further reduced. More generally, it will be appreciated by those skilled in the art that a variety of such configurations and features of a door trim system 20 may be combined depending on the context to achieve the desired finished garage door G appearance in accordance with aspects of the present invention without departing from its spirit and scope. By way of further illustration and not limitation, in any such exemplary embodiment, one or more of any of the trim pieces 30, 30', 40, 40' may be manufactured or assembled in units or sub-assemblies prior to installation on the garage door G or may each individually be assembled or installed onto the door G. Similarly, the various panels 60 retained by the trim system 20 may be singular or composite, which will be further appreciated in view of the below discussion in connection with the additional alternative exemplary embodiments of FIGS. 6-12. Moreover, and by way of still further illustration and not limitation, in any such exemplary embodiment, particularly involving a continuous width-wise horizontal trim piece 40' as shown in FIG. 5, installation of the trim system 20 may involve first securing the upper and far-right trim pieces 30, 40' to the garage door G such as on the first section outer surface S1S, sliding or positioning the upper right panel 60 so that its right vertical edge 66 is nested in the undercut 50 of the vertical trim piece 30 and its top edge 68 is nested in the undercut 50 of the horizontal trim piece 40', installing an intermediate vertical trim piece 30' so that it abuts the top horizontal trim piece 40' and its right undercut 50 secures the left vertical edge 66 of the panel 60, sliding or positioning the next panel 60 so that its right vertical edge 66 is nested in the left undercut 50 of the intermediate vertical trim piece 30' and its top edge 68 is also nested in the undercut 50 of the horizontal trim piece 40', and so on until an entire door section is overlaid, then securing the bottom horizontal trim piece 40' over all such panel lower horizontal edges 68 and abutting all such vertical trim pieces 30, 30'. Or, the bottom horizontal trim piece 40' could be secured on the door G when the top horizontal trim piece 40' and far-right vertical trim piece 30 are first installed so that a door section overlay is completed by successively sliding in a panel 60 underneath the undercuts 50 of opposite horizontal trim pieces 40', from left to right in this example, and securing the next adjacent vertical trim piece 30, 30' between the two horizontal trim pieces 40' such that its right undercut 50 is positioned over the exposed vertical edge 66 of a given panel 60. Those skilled in the art will appreciate that these and a variety of other installation procedures may be employed in conjunction with a trim system 20 according to aspects of the present invention without departing from its spirit and scope.

Aesthetically, those skilled in the art will appreciate that the trim outer surfaces 32, 42 and outer and inner edges 36, 38, 46, 48 may be contoured, beveled, relieved, textured, or otherwise formed with surface treatment or features to suit the application, or the particular appearance sought for the finished garage door G, such that the smooth and flat features with square or ninety-degree edge corners shown in the exemplary trim systems 20 of FIGS. 1-5 are to be understood as merely illustrative and non-limiting. That is, such exposed surfaces 32, 42 or edges 36, 38, 46, 48 of the trim pieces 30, 30', 40, 40' may be formed or fashioned to have the appearance of wood or wood grain, and whether finished or roughhewn, metal, or other material and related surface appearance or treatment and cross-section or profile, as well as a virtually infinite variety of colors and finishes, again, to suit a particular overall or resulting appearance of the garage door G with overlay trim system 20 according to aspects of the present invention. Similarly, and as will also be appreciated with reference to the alternative embodiment of FIGS. 6-11, the retained panels 60 may likewise be formed from any appropriate material and with any appropriate surface features to form or simulate a desired garage door G appearance. In the exemplary context of the garage door G and related trim systems 20 of FIGS. 1-5 configured to give the traditional overhead garage door G the appearance of an aluminum full-view door, it will be appreciated that the trim pieces 30, 30', 40, 40' are thus configured either from metal or with surface treatment to give the appearance of metal, again in a variety of colors and textures, in any case generally having relatively straighter lines and defined corners consistent with a more modern look. Further, the retained panels 60 are again thus configured to give the appearance of windows as being made of glass, plexiglass, polycarbonate, acrylic, or the like. And where the underlying garage door G is formed having continuous sections S1, S2, S3, S4 (i.e., without any actual windows), it will be appreciated that such panels 60 may thus be tinted, frosted, glazed, opaque, or otherwise not be transparent, whether through appropriate material treatment throughout the panel section or on its outer and/or inner surface 62, 64. Alternatively, where the underlying door G has or is to have actual windows in at least one of the sections S1, S2, S3, S4, the corresponding panel(s) 60 may then be transparent or semi-transparent as overlying such actual windows to still allow light through, though not necessarily so. It is also noted in connection with FIGS. 1-5, as well as the alternative exemplary embodiment of FIGS. 6-11, that while in each such exemplary embodiment the perimeter vertical and horizontal trim pieces 30, 40, 40' are shown as substantially aligning with the perimeter of the garage door G, or the vertical and horizontal outer edges 36, 46 thereof with the respective door outer edges S1E1, S1E2 such as shown particularly in FIG. 2A in connection with the top door section S1, those skilled in the art will appreciate that such is not required and that in some contexts it would be preferable to have the perimeter trim pieces 30, 40, 40' inset from the garage door edges to account for the garage door opening and track configuration in the related building or structure (not shown), such alternative positioning or placement of the trim system 20 on the underlying garage door G being encompassed within the scope of the present invention. More generally, any appropriate size and arrangement of panels 60 and corresponding configuration and pattern of trim pieces 30, 30', 40, 40' is possible according to aspects of the present invention without departing from its spirit and scope, and it is to be expressly understood that any such overhead garage door trim system 20 may be positioned on all or part of the garage door G or any section S1, S2, S3, S4 thereof, such that even a single section may not be entirely covered by any related pattern or placement of the trim system 20.

Turning next to FIGS. 6-11, there is shown an alternative exemplary overhead garage door trim system 20 according to aspects of the present invention as installed on an illustrative garage door G, here configured as an otherwise conventional single-car door G with a "carriage house" style trim system 20. Of course, those skilled in the art will appreciate that such a trim system 20 could be effectively "doubled up" so as to be installed on a two-car garage door G as in the exemplary embodiments of FIGS. 1-5. And in any case, any such trim system 20 may also include double-width interior vertical trim pieces 30' (FIGS. 2B-4B and 5) and/or continuous width-wise horizontal trim pieces 40' (FIG. 5) or other such configurations according to aspects of the present invention. Here, the alternative illustrated system 20 again comprises, in the exemplary embodiment, a plurality of selectively abutting vertical trim pieces 30 and horizontal trim pieces 40 each having along the underside of its respective inner edge 38, 48 (FIG. 7) at least one lengthwise undercut 50, 52 (FIGS. 8 and 10) configured to receive a perimeter edge 66, 68, 76, 78, 96, 98 (FIG. 7) of an underlying overlay panel 60, 70, 90 (FIG. 7) that is thereby clamped or retained on or adjacent to the door G, and specifically a section S1, S2, S3, S4 thereof, while the panel 60, 70, 90 itself is once more not mounted but instead floating within opposed vertical and horizontal trim pieces 30, 40 as retained by their respective undercuts 50, 52.

Figure 6:
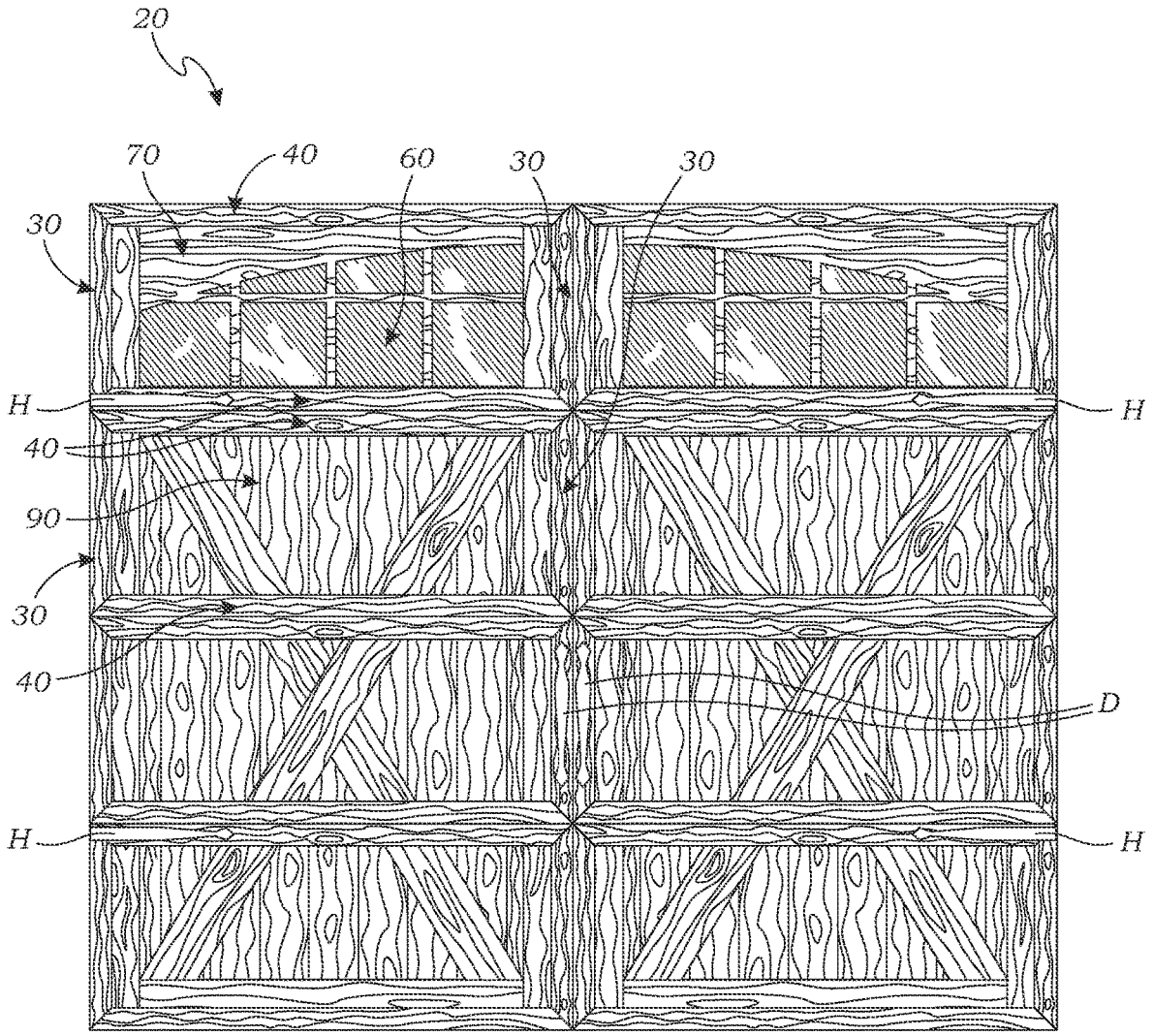
FIG. 6 is a front view of a still further exemplary overhead garage door trim system as installed on a one-car four-section garage door, in accordance with at least one embodiment.
Figure 7:
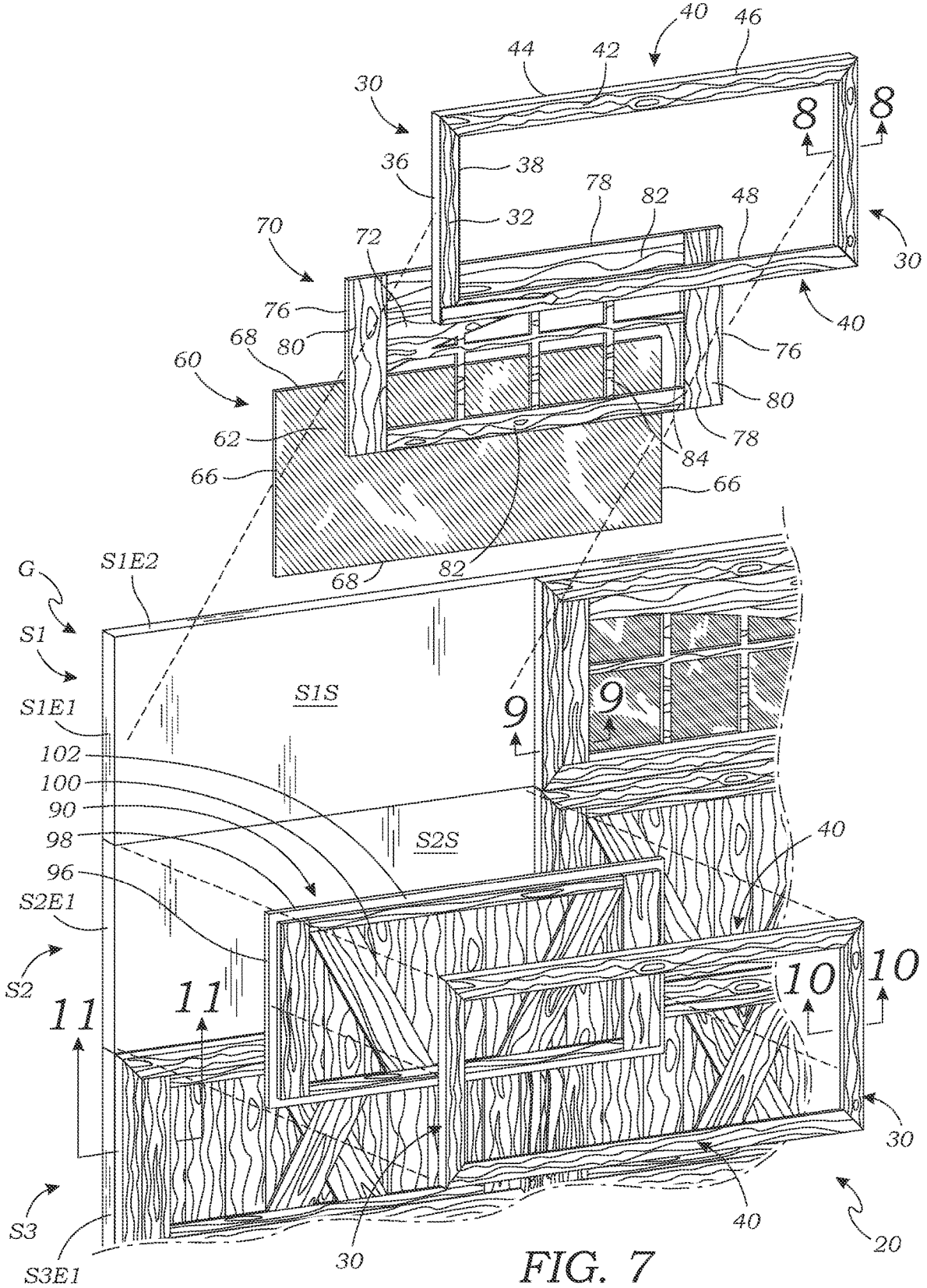
FIG. 7 is an enlarged partial exploded perspective view thereof, in accordance with at least one embodiment.
Figure 8:
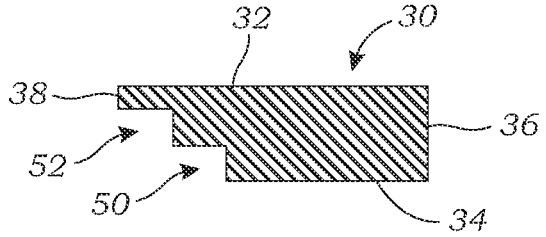
FIG. 8 is an enlarged cross-sectional view of a trim piece thereof taken from line 8-8 in FIG. 7, in accordance with at least one embodiment.
Figure 9:
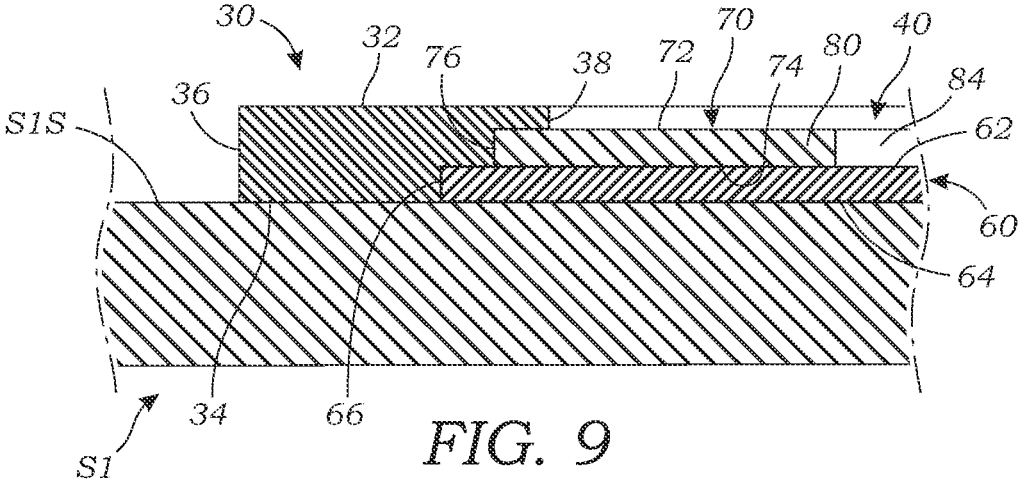
FIG. 9 is an enlarged cross-sectional view of a trim piece and two-panel assembly thereof taken from line 9-9 in FIG. 7, in accordance with at least one embodiment.

In more detail with reference to FIGS. 7-9 and the window-style trim system 20 components employed on the upper or top section S1 of the garage door G, it can be seen that two separate panels 60, 70 are secured one on top of the other by a single set of trim pieces 30, 40. The first or inner panel 60 is again here formed as a piece of glass, plexiglass, polycarbonate, acrylic, or the like so as to have a window appearance, with or without being tinted, frosted, glazed, opaque, or otherwise not transparent as through appropriate material treatment throughout the panel section or on its outer and/or inner surface 62, 64. In any case, the inner surface 64 of the inner panel 60 would be substantially adjacent to the surface S15 of the garage door upper section S1 as best seen in FIG. 9. Overlaying the inner glass or glass-looking panel 60 there is an outer panel 70 here configured with a window-style design as by having opposite vertical stiles 80 and opposite horizontal sashes or rails 82 that together cooperate to provide a window frame look. Moreover, in the exemplary embodiment the top horizontal rails 82 of the two adjacent panels 70 (as seen in FIG. 6) have opposite arches or arch shapes and each such panel 70 has a grid pattern of vertical and horizontal intersecting muntins 84 spanning between the opposite stiles 80 and rails 82, respectively, here three such vertical muntins 84 and one such horizontal muntin 84 in each window-frame panel 70 to give the appearance of eight individual window panes, formed in the overlay panel 70 to further complete the typical "carriage house" door style or appearance. Though again, those skilled in the art will appreciate that such stiles 80 and rails 82 may take a variety of configurations or appearances as may the number and arrangement of muntins 84, such as to give each window frame or panel 70 a 3-pane, 4-pane, 6-pane, 8-pane, or other such look, and that with either a single overall arch across the door G, a double-arch, or no arch, without departing from the spirit and scope of the invention. As best seen in FIG. 9, the underside or inner surface 74 of the outer window frame-like panel 70 overlays or is substantially adjacent to the outer surface 62 of the inner window-like panel 60. And as also best seen in FIGS. 8 and 9, the exemplary trim pieces 30, 40 here for the top section S1 of the door G have a double-step or two offset undercuts 50, 52, the first undercut 50 configured to clamp or retain the inner window-like panel 60 and the second undercut 52 configured to clamp or retain the outer window frame-like panel 70. With the two undercuts 50, 52 being stepped, or the inner or first undercut 50 being longer than the outer or second undercut 52, it will be appreciated that the overall perimeters of the respective panels 60, 70 would be sized accordingly, namely, in this example the inner panel 60 would have a relatively larger perimeter than the outer panel 70 corresponding to the stepped undercuts 50, 52. However, those skilled in the art will appreciate that such is not necessary and indeed a single trim piece undercut 50 could be formed of sufficient depth to clamp or retain both panels 60, 70, which would thus have substantially equivalent perimeters instead.

Figure 10:
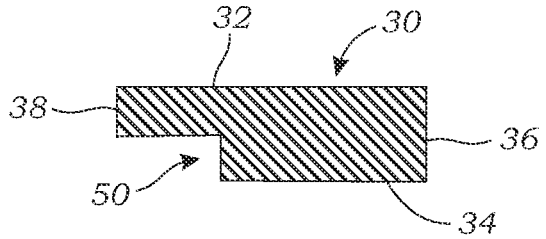
FIG. 10 is an enlarged cross-sectional view of a trim piece thereof taken from line 10-10 in FIG. 7, in accordance with at least one embodiment.
Figure 11:
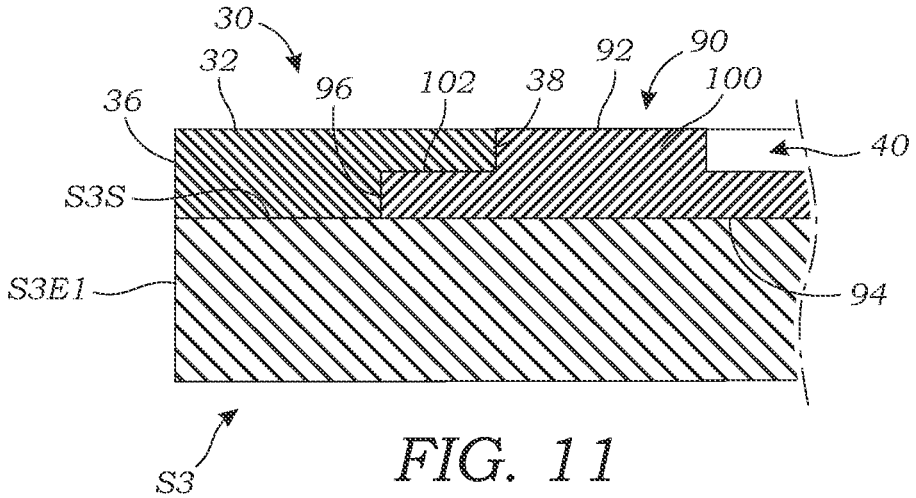
FIG. 11 is an enlarged cross-sectional view of a trim piece and panel assembly thereof taken from line 11-11 in FIG. 7, in accordance with at least one embodiment.

Referring briefly to FIGS. 10 and 11 in conjunction with FIGS. 6 and 7, the remaining sections S2, S3, S4 of the garage door G are configured with wood-looking "carriage house" door-style trim system 20 components here involving single built-up panels 90 secured by vertical and horizontal trim pieces 30, 40. The inner surface 94 of each lower panel 90 would be substantially adjacent to the respective surfaces S2S, S3S of the garage door second and third sections S2, S3, and so on, as best seen in FIGS. 7 and 11. And as best seen in FIGS. 10 and 11, the exemplary trim pieces 30, 40 here for the second and third sections S2, S3 of the door G have a profile similar to that in the exemplary embodiments of FIGS. 1-5 with a single undercut 50 configured to clamp or retain the perimeter of the lower panel 90. More particularly, in the exemplary embodiment, the panel 90 is formed having an outer flange or step 102 about its perimeter configured having a thickness corresponding to the trim piece undercut 50. Accordingly, those skilled in the art will appreciate, particularly with reference to FIG. 11, that the outer surface 92 of the panel 90 thus is or is able to be somewhat at the same level with or coplanar with the outer surfaces 32, 42 of the respective trim pieces 30, 40 so as to give a more consistent or flushed look to the overall door trim system 20 in approximating the appearance of a traditional "carriage house" door. Aesthetically, then, it will be appreciated by those skilled in the art that all such trim pieces 30, 40 and panels 70, 90 of the alternative exemplary "carriage house" door-style trim system 20 of FIGS. 6-11 may be configured to have a wood or wood-grain appearance, including color and texture, employing any appropriate material and manufacturing and finishing method now known or later developed, with the lower wood-like panels 90 even having raised outer features 100 to give the appearance of boards installed in constructing traditional "carriage house" doors, including for example boards that are arranged diagonally on the face of the door trim system 20 so that across a number of adjacent sections S2, S3, S4 there is for example even the appearance of an "X" arrangement of boards as seen in FIG. 6. Moreover, while the profiles of the trim pieces 30, 40 and panels 70, 90 are for the sake of illustration again shown as being somewhat flat or planar with square or perpendicular corners, such is not required and may indeed not be the case, again in the interest of simulating a wood-looking construction.

In the production or assembly of an alternative exemplary overhead garage door trim system 20 according to aspects of the present invention as shown in FIGS. 6-11, each panel 60, 90 is again simply positioned on or adjacent to the garage door G, specifically an appropriate location on a section surface S1S, S2S, S3S, S4S thereof, in the case of upper section S1 the window frame-looking outer panel 70 is positioned on or adjacent to the underlying window-looking panel 60, and the respective trim pieces 30, 40 are installed about the panels 60, 70, 90 such that the undercuts 50, 52 as appropriate are positioned adjacent to the respective panels 60, 70, 90. Specifically, in the case of the window-style trim system 20 components of the upper section S1 of the door G and the use of trim pieces 30, 40 with double-undercut 50, 52, the first undercut 50 of the left vertical trim piece 30 is substantially adjacent to the left vertical edge 66 and outer surface 62 of the inner window-like panel 60 and the second undercut 52 of the left vertical trim piece 30 is substantially adjacent to the left vertical edge 76 and outer surface 72 of the outer window frame-like panel 70 with the left vertical trim piece inner edge 38 thus overlying the left vertical edge 76 and outer surface 72 of the outer panel 70, and so on about the top, right side, and bottom of the stacked panels 60, 70, thereby securing the panels 60, 70 on the door G face without actually mounting or adhering the panels 60, 70 to the door G or each other, each instead essentially "floating" within the frame of clamping trim pieces 30, 40 thereabout. Similarly, in the lower second, third, and fourth door sections S2, S3, S4, the undercut 50 of the left vertical trim piece 30 is substantially adjacent to the left vertical edge 96 and outer surface 92 of the wood-like panel 90 with the left vertical trim piece inner edge 38 thus overlying the left vertical edge 96 and outer surface 92 of the panel 90, and so on about the top, right side, and bottom of the panel 90, thereby securing the panel 90 on the door G face again without actually mounting or adhering the panel 90 to the door G, the panel 90 instead essentially "floating" within the frame of clamping trim pieces 30, 40 thereabout. And in each case, sufficient material or a sufficient portion of the inner surface 34, 44 of the respective vertical and horizontal trim pieces 30, 40 and accordingly the exposed areas of the underlying garage door sections S1, S2, S3, S4 about the perimeters of the panels 60, 90 remains for installing, fastening, or otherwise mounting the trim pieces 30, 40 on the garage door surfaces S1S, S2S, S3S, S4S so as to clamp or retain one or more of the respective panels 60, 70, 90. Once again, those skilled in the art will appreciate that such assembly technique allows for readily customizing the combination of trim pieces 30, 40 and panels 60, 70, 90 on a particular overhead garage door G to achieve a desired overall appearance and reduces the amount of labor and materials in assembly, particularly regarding the fasteners for the trim pieces 30, 40, such as for example the amount of glue needed to install the overlay trim system 20. In an exemplary embodiment, the trim pieces 30, 40 are glued or bonded to the respective underlying garage door surface S1S, S2S, S3S, S4S, though it will be appreciated that any appropriate fastening system or device now known or later developed and whether temporary or permanent may be employed. Where the trim pieces 30, 40 are glued or bonded, while the inner surface 34 is shown as smooth or flat, it will again be appreciated that grooves or channels, notches, reliefs, roughing or texturing, or other such surface feature(s) of the trim piece inner surface 34, 44 may be employed to facilitate such bonding. And again, while in FIGS. 9 and 11, the outer surfaces 62, 72, 92 and left vertical edges 66, 76, 96 of the panels 60, 70, 90 are shown as substantially abutting the undercuts 50, 52, it will be appreciated that such is not necessary and a gap can be and preferably would be provided therebetween, or between all such panel edges 66, 68, 76, 78, 96, 98 and trim piece undercuts 50, 52 to account both for tolerance accommodation in assembly and for thermal expansion and contraction of the components in normal use in the elements such as seasonal temperature variations, rain, and wind without compromising the integrity of the installation of the overlay trim system 20 on the underlying garage door G, as again by having the panels 60, 70, 90 "float" within the adjacent frame of trim pieces 30, 40. It will be appreciated once more that templates, jigs, fixtures, or the like may be provided in conjunction with laying down and assembling the panels 60, 70, 90 and trim pieces 30, 40 on a door G for relatively rapid and repeatable assembly. To complete the "carriage house" door appearance, hinges H and handles D may be installed on or incorporated in the trim system 20 as shown in FIG. 6.

Figure 12:
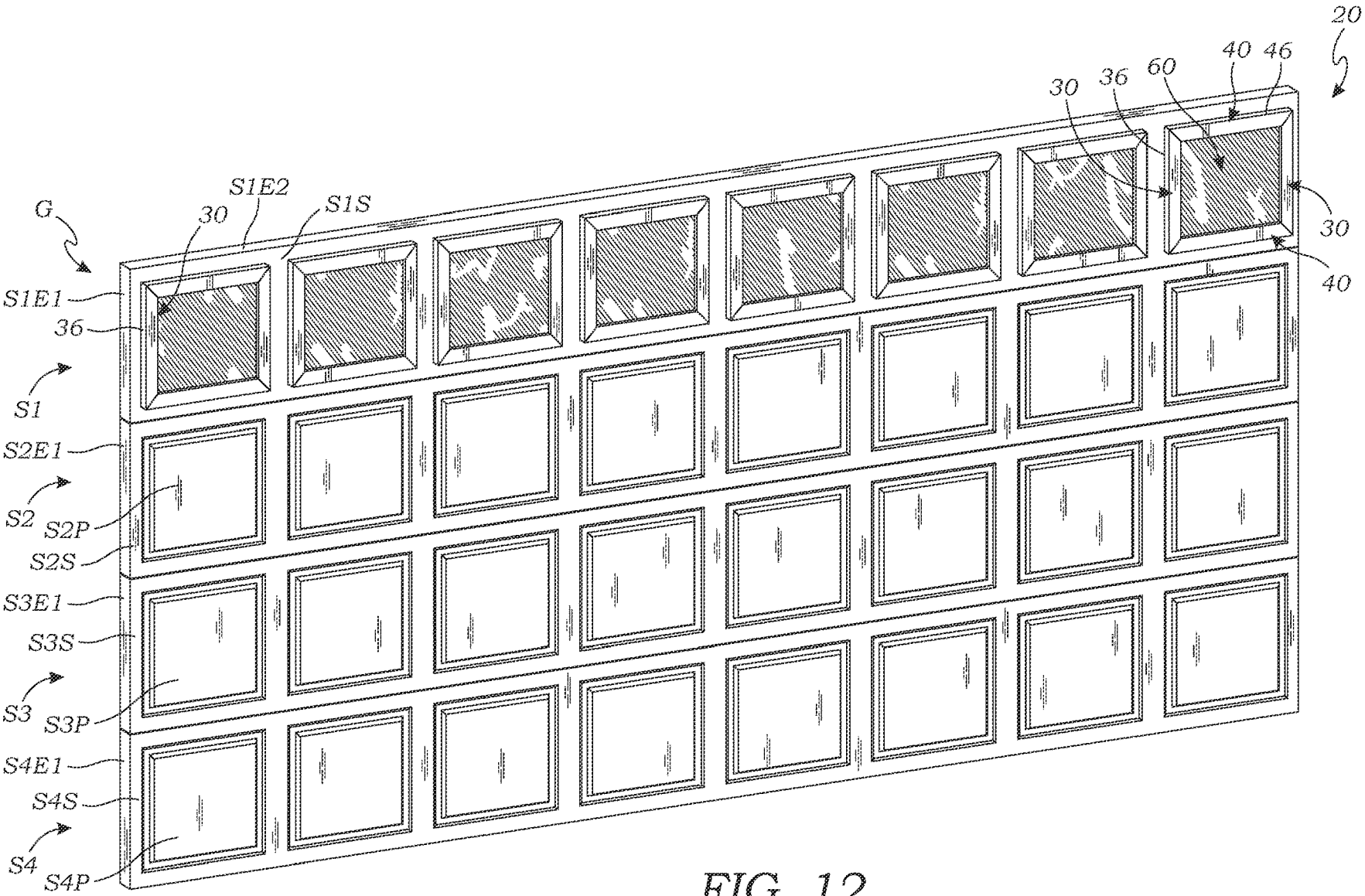
FIG. 12 is a perspective view of a still further exemplary overhead garage door trim system as installed on a two-car four-section garage door, in accordance with at least one embodiment.

Turning finally to FIG. 12, there is shown a perspective view of yet another alternative exemplary overhead garage door trim system 20 according to aspects of the present invention as installed on an illustrative garage door G, here again configured as an otherwise conventional two-car door G. The steel or other standard construction door G is again illustrated with four horizontal sections S1, S2, S3, S4, each, or at least the three lower sections S2, S3, S4 as visible in the exemplary embodiment, having a pattern of spaced apart raised panels S2P, S3P, S4P stamped or otherwise formed in the respective door section outer surfaces S2S, S3S, S4S as shown and as is known in the art. To give the appearance of individual windows in such an otherwise conventional garage door G, a further trim system 20 according to aspects of the present invention is shown as comprising individual window panels 60 each secured about its perimeter by vertical and horizontal trim pieces 30, 40 essentially as set forth herein for other exemplary embodiments. In the exemplary embodiment, each lower door section S2, S3, S4 has eight raised panels S2P, S3P, S4P each and eight corresponding window-style trim system 20 assemblies are positioned on the first or top door section S1. Notably, the panels 60 are sized and the trim pieces 30, 40 located so as to be inset from the edges of the garage door G, and particularly their outer edges 36, 46 from the upper section left and right vertical edges S1E1 and top edge S1E2, such that visually the trim system 20 windows are symmetrical and aligned with the raised panels S2P, S3P, S4P as such are inset particularly horizontally from the vertical edges S2E1, S3E1, S4E1 of the respective lower three sections S2, S3, S4 and from each other in a substantially symmetrical arrangement, though of course that is not required. And as indicated previously, where the underlying garage door G is formed having continuous sections S1, S2, S3, S4 (i.e., without any actual windows), it will be appreciated that such window-like panels 60 may thus be tinted, frosted, glazed, opaque, or otherwise not be transparent, whether through appropriate material treatment throughout the panel section or on its outer and/or inner surface 62, 64 (FIGS. 2A and 4A) so as to give the appearance of windows. Those skilled in the art will appreciate that such trim system 20 here configured as individual windows can thus be placed in any location, pattern, or arrangement on an underlying garage door G, and whether or not the underlying door section surfaces SIS, S2S, S3S, S4S are flat or have raised panels or other such features, such that the exemplary arrangement just along the top section S1 is to be understood as merely illustrative and non-limiting. Once more, it is to be expressly understood that any such overhead garage door trim system 20 may be positioned on all or part of the garage door G or any section S1, S2, S3, S4 thereof, such that even a given section may not be entirely covered by any related pattern or placement of the trim system 20, here the pattern or placement of individual windows comprising the trim system 20, which need not necessarily span the entirety of the top section S1 and/or windows comprising the trim system 20 could be added in any desired positions or patterns on one or more of sections S2, S3, S4 as well. Furthermore, where all sections S1, S2, S3, S4 have features formed in their outer surfaces SIS, S2S, S3S, S4S such as the raised panels S2P, S3P, S4P shown in FIG. 12, it will be appreciated that the inner surfaces 34, 44 (FIGS. 2-4) of the respective trim pieces 30, 40 may be formed with corresponding structure to engage or mate with related structure or features on the underlying door G in further assisting with the location and installation of such trim pieces 30, 40 and thus the overall trim system 20 on the door G.

In forming the trim pieces 30, 40 and panels 60, 70, 90 as part of an overhead garage door trim system 20 according to aspects of the present invention, it will be appreciated that any appropriate materials and methods of construction now known or later developed may be employed, including but not limited to lightweight metals and metal alloys such as aluminum, a variety of plastics such as polypropylene, polystyrene, polyvinyl chloride ("PVC"), acrylonitrile butadiene styrene ("ABS"), polyethylenes such as high density polyethylene ("HDPE") and low density polyethylene ("LDPE"), polycarbonate, polyurethane, and other such plastics, thermoplastics, thermosetting polymers, foams, and the like, and in the case of any window-like panels or components including but not limited to glass, plexiglass, polycarbonate, acrylic, or the like, again with or without any coloring or embedded or surface tinting, frosting, glazing, or the like, any such components being fabricated or formed as through injection molding, casting, extrusion, machining, stamping, forming, or any other such technique now known or later developed. Relatedly, such components may be formed integrally or may be formed separately and then assembled in any appropriate secondary operation employing any assembly technique now known or later developed, including but not limited to fastening, bonding, welding, over-molding or coining, press-fitting, snapping, or any other such technique now known or later developed. Those skilled in the art will fundamentally appreciate that any such materials and methods of construction are encompassed within the scope of the invention, any exemplary materials and methods in connection with any and all embodiments thus being illustrative and non-limiting.

Aspects of the present specification may also be described as follows:

1. An overhead garage door trim system for installation on an overhead garage door having a plurality of sections, the overhead garage door trim system comprising: a plurality of trim pieces, each trim piece having a trim piece inner surface and at least one trim piece undercut formed in the trim piece inner surface along a trim piece inner edge, the trim pieces configured to be installed spaced-apart along an at least one section of the plurality of sections of the overhead garage door with respective trim piece inner edges opposed; and at least one panel configured to be positioned on the at least one section of the overhead garage door and secured thereon by the plurality of trim pieces, each panel having edges configured to be secured within opposite trim piece undercuts of spaced-apart trim pieces; wherein in use the at least one panel is clamped and retained on the overhead garage door without itself being installed on the overhead garage door so as to float within the respective trim piece undercuts, thereby reducing material costs and mitigating against adverse thermal expansion effects on the overhead garage door trim system.

2. The overhead garage door trim system of embodiment 1 wherein the plurality of trim pieces comprises: a plurality of vertical trim pieces, each vertical trim piece having a vertical trim piece inner surface and a vertical trim piece undercut formed in the vertical trim piece inner surface along a vertical trim piece inner edge, the vertical trim pieces configured to be installed spaced-apart along the width of the at least one section of the overhead garage door with respective vertical trim piece inner edges opposed; and a plurality of horizontal trim pieces configured to abut respective vertical trim pieces, each horizontal trim piece having a horizontal trim piece inner surface and a horizontal trim piece undercut formed in the horizontal trim piece inner surface along a horizontal trim piece inner edge, the horizontal trim pieces configured to be installed spaced-apart along the height of the at least one section of the overhead garage door with respective horizontal trim piece inner edges opposed; wherein the at least one panel is configured to be secured on the at least one section of the overhead garage door by the plurality of vertical and horizontal trim pieces, each panel having opposite vertical edges configured to be secured within opposite vertical trim piece undercuts of spaced-apart vertical trim pieces and further having opposite horizontal edges configured to be secured within opposite horizontal trim piece undercuts of spaced-apart horizontal trim pieces.

3. The overhead garage door trim system of embodiment 2 wherein the vertical and horizontal trim pieces each have angle-cut ends so that the vertical and horizontal trim pieces abut along a forty-five degree angle.

4. The overhead garage door trim system of embodiment 2 wherein the vertical and horizontal trim pieces each have square-cut ends so that the vertical and horizontal trim pieces abut perpendicularly.

5. The overhead garage door trim system of any of embodiments 2-4 wherein at least one of the plurality of horizontal trim pieces is configured to span the width of the at least one section of the overhead garage door.

6. The overhead garage door trim system of any of embodiments 2-5 wherein at least one of the plurality of vertical trim pieces has opposite vertical trim piece undercuts formed in the vertical trim piece inner surface along opposite vertical trim piece inner edges, whereby in use one vertical trim piece can secure the vertical edges of two panels.

7. The overhead garage door trim system of any of embodiments 2-6 wherein in use two offset vertical trim pieces and two offset horizontal trim pieces and thus four trim pieces total secure each panel.

8. The overhead garage door trim system of any of embodiments 1-7 wherein the at least one panel is formed having an outer feature.

9. The overhead garage door trim system of any of embodiments 1-8 wherein the at least one panel is formed having an outer perimeter step configured to be secured within the trim piece undercut.

10. The overhead garage door trim system of embodiment 8 or embodiment 9 wherein: each trim piece has a trim piece outer surface opposite the trim piece inner surface; the at least one panel has a panel outer surface defined by the outer feature; and in use, the trim piece outer surfaces and the panel outer surface are flush.

11. The overhead garage door trim system of any of embodiments 1-10 wherein the at least one panel is wood-looking.

12. The overhead garage door trim system of any of embodiments 1-11 wherein the at least one panel is window-looking.

13. The overhead garage door trim system of embodiment 12 wherein the at least one panel is selected from the group consisting of glass, plexiglass, polycarbonate, and acrylic.

14. The overhead garage door trim system of embodiment 12 or embodiment 13 wherein the at least one panel is tinted, frosted, or glazed.

15. The overhead garage door trim system of any of embodiments 1-14 wherein the at least one panel is opaque.

16. The overhead garage door trim system of any of embodiments 1-15 wherein the at least one panel comprises: an at least one inner panel; and an at least one outer panel overlying the at least one inner panel.

17. The overhead garage door trim system of embodiment 16 wherein: the at least one inner panel is window-looking; and the at least one outer panel is window frame-looking.

18. The overhead garage door trim system of embodiment 17 wherein the at least one inner panel is selected from the group consisting of glass, plexiglass, polycarbonate, and acrylic.

19. The overhead garage door trim system of embodiment 17 or embodiment 18 wherein the at least one inner panel is tinted, frosted, or glazed.

20. The overhead garage door trim system of any of embodiments 17-19 wherein the at least one inner panel is opaque.

21. The overhead garage door trim system of any of embodiments 17-20 wherein the at least one outer panel has opposite vertical stiles and opposite horizontal rails.

22. The overhead garage door trim system of embodiment 21 wherein at least one muntin spans between opposite vertical stiles or opposite horizontal rails.

23. The overhead garage door trim system of embodiment 22 comprising at least two muntins, with at least one muntin spanning between opposite vertical stiles and at least one muntin spanning between opposite horizontal rails.

24. The overhead garage door trim system embodiment 22 or embodiment 23 wherein the at least one outer panel has a configuration selected from the group consisting of 3-pane, 4-pane, 6-pane, and 8-pane.

25. The overhead garage door trim system of any of embodiments 21-24 wherein at least one of the horizontal rails is arched.

26. The overhead garage door trim system of any of embodiments 16-25 wherein: the perimeter of the at least one inner panel is larger than the perimeter of the at least one outer panel; and the at least one trim piece undercut of each trim piece comprises a first trim piece undercut and a second trim piece undercut, the first trim piece undercut corresponding to the at least one inner panel and the second trim piece undercut corresponding to the at least one outer panel and being above and smaller than the first trim piece undercut.

27. The overhead garage door trim system of any of embodiments 1-26 wherein the plurality of trim pieces are metal-looking.

28. The overhead garage door trim system of any of embodiments 1-26 wherein the plurality of trim pieces are wood-looking.

29. The overhead garage door trim system of any of embodiments 1-28 wherein the plurality of trim pieces and a plurality of panels are configured to be arranged in a pattern on one or more overhead garage door sections.

30. The overhead garage door trim system of any of embodiments 1-29 wherein the plurality of trim pieces and a plurality of panels are configured to cover all overhead garage door sections.

31. An overhead garage door with overhead garage door trim system installed on at least one of a plurality of sections of the overhead garage door, the overhead garage door trim system comprising: a plurality of horizontal trim pieces, each horizontal trim piece having a horizontal trim piece inner surface and a horizontal trim piece undercut formed in the horizontal trim piece inner surface along a horizontal trim piece inner edge, the horizontal trim pieces installed spaced-apart along the height of the at least one section of the overhead garage door; a plurality of vertical trim pieces, each vertical trim piece having a vertical trim piece inner surface and a vertical trim piece undercut formed in the vertical trim piece inner surface along a vertical trim piece inner edge, the vertical trim pieces installed spaced-apart along the width of the at least one section of the plurality of sections of the overhead garage door in abutting relationship to respective horizontal trim pieces; and at least one panel positioned on the at least one section of the overhead garage door and secured thereon by the plurality of vertical and horizontal trim pieces, each panel having opposite horizontal edges secured within opposite horizontal trim piece undercuts of spaced-apart horizontal trim pieces and further having opposite vertical edges secured within opposite vertical trim piece undercuts of spaced-apart vertical trim pieces; wherein the at least one panel is clamped and retained on the overhead garage door without itself being installed on the overhead garage door so as to float within the respective vertical and horizontal trim piece undercuts, thereby reducing material costs and mitigating against adverse thermal expansion effects on the overhead garage door trim system.

32. A method of employing an overhead garage door trim system as defined in any one of embodiments 1-31, the method comprising the steps of: positioning the at least one panel on the at least one section of the overhead garage door; and installing the trim pieces spaced-apart along the at least one section of the overhead garage door adjacent to the at least one panel with the respective trim piece inner edges opposed and the respective trim piece undercuts securing the at least one panel; wherein the at least one panel is clamped and retained on the overhead garage door without itself being installed on the overhead garage door so as to float within the respective trim piece undercuts.

33. The method of embodiment 32 further comprising the step of selecting the at least one panel from the group consisting of a window-looking panel, a window frame-looking panel, and a wood-looking panel.

34. The method of embodiment 32 or embodiment 33 wherein the step of positioning the at least one panel involves overlying an outer panel on an inner panel.

35. The method of embodiment 34 wherein the step of overlying an outer panel on an inner panel includes selecting a window-looking panel as the inner panel and selecting a window frame-looking panel as the outer panel.

36. The method of any of embodiments 32-35 wherein the step of positioning the at least one panel involves one or more of a template, jig, fixture, and a feature of the at least one section of the overhead garage door.

37. The method of any of embodiments 32-36 wherein the step of installing the trim pieces includes adhering the trim piece inner surface of the respective trim piece onto the at least one section of the overhead garage door.

38. The method of any of embodiments 32-37 wherein the step of installing the trim pieces includes installing at least one horizontal trim piece spanning the width of the at least one section of the overhead garage door.

39. The method of embodiment 38 wherein the step of installing the trim pieces includes installing two spaced-apart horizontal trim pieces each spanning the width of the at least one section of the overhead garage door.

40. The method of embodiment 39 further comprising sequentially sliding each of the at least one panels between the spaced-apart horizontal trim pieces so as to be secured horizontally by the respective horizontal trim piece undercuts.

41. The method of embodiment 40 further comprising installing a vertical trim piece adjacent to each panel in sequence, wherein a first vertical trim piece is installed spanning the spaced-apart horizontal trim pieces, a first panel is slid between the spaced-apart horizontal trim pieces until the first panel abuts the first vertical trim piece, a second vertical trim piece is installed spanning the spaced-apart horizontal trim pieces also abutting the first panel opposite the first vertical trim piece, a second panel is slid between the spaced-apart horizontal trim pieces until the second panel abuts the second vertical trim piece, and so on across the at least one section of the overhead garage door.

42. The method of any of embodiments 32-41 wherein the step of installing the trim pieces includes installing at least one vertical trim piece having opposite vertical trim piece undercuts to secure the vertical edges of two adjacent panels.

43. The method of any of embodiments 32-42 wherein the step of installing the trim pieces involves one or more of a template, jig, fixture, and a feature of the at least one section of the overhead garage door.

44. The method of any of embodiments 32-43 wherein the step of installing the trim pieces involves engaging the inner surfaces of the trim pieces with raised panel features on the at least one section of the overhead garage door.

45. A kit comprising an overhead garage door trim system as defined in any one of embodiments 1-31.

46. The kit of embodiment 45 further comprising instructional material.

47. The kit of embodiment 46 wherein the instructional material provides instructions on how to perform the method as defined in any one of embodiments 32-44.

48. Use of an overhead garage door trim system as defined in any one of embodiments 1-31 to form features or a facade on at least one section of the overhead garage door.

49. The use of embodiment 48 wherein the use comprises a method as defined in any one of embodiments 32-44.

In closing, regarding the exemplary embodiments of the present invention as shown and described herein, it will be appreciated that an overhead garage door trim system is disclosed and configured for forming features or a facade on at least one section of the overhead garage door. Because the principles of the invention may be practiced in a number of configurations beyond those shown and described, it is to be understood that the invention is not in any way limited by the exemplary embodiments, but is generally able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

In some embodiments, the numbers expressing quantities of components or ingredients, properties such as dimensions, weight, concentration, reaction conditions, and so forth, used to describe and claim certain embodiments of the inventive subject matter are to be understood as being modified in some instances by terms such as "about," "approximately," or "roughly." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in any specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. The recitation of numerical ranges of values herein is merely intended to serve as a shorthand method of referring individually to each separate value falling within the range. Unless otherwise indicated herein, each individual value of a numerical range is incorporated into the specification as if it were individually recited herein. Similarly, all lists of values should be considered as inclusive of intermediate values unless the context indicates the contrary.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated.

All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the application should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

While aspects of the invention have been described with reference to at least one exemplary embodiment, it is to be clearly understood by those skilled in the art that the invention is not limited thereto. Rather, the scope of the invention is to be interpreted only in conjunction with any appended claims here or in any patent application claiming the benefit hereof, and it is made clear that the inventor(s) believe that the claimed subject matter is the invention.

What is claimed is:

1. An overhead garage door trim system for installation on an overhead garage door having a plurality of sections, the overhead garage door trim system comprising:

a plurality of trim pieces, each of the trim pieces having a trim piece inner surface and at least one inwardly-facing trim piece undercut formed in the trim piece inner surface along a trim piece inner edge, the trim pieces configured to be installed spaced-apart along at least one section of the plurality of sections of the overhead garage door with the trim piece inner edges opposed and the trim piece undercuts facing the at least one section of the overhead garage door; and at least one panel configured to be positioned on and abutting the at least one section of the overhead garage door and secured thereon by the plurality of trim pieces, the at least one panel having edges configured to be secured within the trim piece undercuts of the spaced-apart trim pieces;

wherein in use the at least one panel is clamped and retained on the overhead garage door without itself being installed on the overhead garage door so as to float within the respective trim piece undercuts, thereby reducing material costs and mitigating against adverse thermal expansion effects on the overhead garage door trim system.

2. The overhead garage door trim system of claim 1 wherein the at least one section of the overhead garage door has a height and a width and the plurality of trim pieces comprises:

a plurality of vertical trim pieces, each of the vertical trim pieces having a vertical trim piece inner surface and a vertical trim piece undercut formed in the vertical trim piece inner surface along a vertical trim piece inner edge, the vertical trim pieces configured to be installed spaced-apart along the width of the at least one section of the overhead garage door with the vertical trim piece inner edges opposed; and a plurality of horizontal trim pieces configured to abut the vertical trim pieces, each of the horizontal trim pieces having a horizontal trim piece inner surface and a horizontal trim piece undercut formed in the horizontal trim piece inner surface along a horizontal trim piece inner edge, the horizontal trim pieces configured to be installed spaced-apart along the height of the at least one section of the overhead garage door with the horizontal trim piece inner edges opposed;

wherein the at least one panel is configured to be secured on the at least one section of the overhead garage door by the plurality of vertical and horizontal trim pieces, each of the panels having opposite vertical edges configured to be secured within the vertical trim piece undercuts of the spaced-apart vertical trim pieces and further having opposite horizontal edges configured to be secured within the horizontal trim piece undercuts of the spaced-apart horizontal trim pieces.

3. The overhead garage door trim system of claim 2 wherein the vertical and horizontal trim pieces each have square-cut ends so that the vertical and horizontal trim pieces abut perpendicularly.

4. The overhead garage door trim system of claim 3 wherein at least one of the plurality of horizontal trim pieces is configured to span the width of the at least one section of the overhead garage door.

5. The overhead garage door trim system of claim 2 wherein at least one of the plurality of vertical trim pieces has opposite vertical trim piece undercuts formed in the vertical trim piece inner surface along opposite vertical trim piece inner edges, whereby in use one vertical trim piece can secure the vertical edges of two panels.

6. The overhead garage door trim system of claim 1 wherein:

the at least one panel is formed having an outer feature and an outer perimeter step configured to be secured within the trim piece undercut, a panel outer surface being defined by the outer feature;

each of the trim pieces has a trim piece outer surface opposite the trim piece inner surface; and in use, the trim piece outer surfaces and the panel outer surface are flush.

7. The overhead garage door trim system of claim 1 wherein the at least one panel is window-looking.

8. The overhead garage door trim system of claim 1 wherein the at least one panel comprises:

an at least one inner panel; and an at least one outer panel overlying the at least one inner panel.

9. The overhead garage door trim system of claim 8 wherein:

the at least one inner panel is window-looking; and the at least one outer panel is window frame-looking.

10. The overhead garage door trim system of claim 9 wherein:

the at least one outer panel has opposite vertical stiles and opposite horizontal rails; and at least one muntin spans between the opposite vertical stiles or the opposite horizontal rails.

11. The overhead garage door trim system of claim 8 wherein:

a perimeter of the at least one inner panel is larger than a perimeter of the at least one outer panel; and the at least one trim piece undercut of each of the trim pieces comprises a first trim piece undercut and a second trim piece undercut, the first trim piece undercut corresponding to the at least one inner panel and the second trim piece undercut corresponding to the at least one outer panel and being above and smaller than the first trim piece undercut.

12. The overhead garage door trim system of claim 1 wherein the plurality of trim pieces are metal-looking.

13. The overhead garage door trim system of claim 1 wherein the plurality of trim pieces and the at least one panel are wood-looking.

14. An overhead garage door with overhead garage door trim system installed on at least one of a plurality of sections of the overhead garage door, the at least one section of the overhead garage door having a height and a width, the overhead garage door trim system comprising:

a plurality of horizontal trim pieces, each of the horizontal trim pieces having a horizontal trim piece inner surface and a horizontal trim piece undercut formed in the horizontal trim piece inner surface along a horizontal trim piece inner edge, the horizontal trim pieces installed spaced-apart along the height of the at least one section of the overhead garage door;

a plurality of vertical trim pieces, each of the vertical trim pieces having a vertical trim piece inner surface and a vertical trim piece undercut formed in the vertical trim piece inner surface along a vertical trim piece inner edge, the vertical trim pieces installed spaced-apart along the width of the at least one section of the plurality of sections of the overhead garage door in abutting relationship to the horizontal trim pieces; and at least one panel positioned on the at least one section of the overhead garage door and secured thereon by the plurality of vertical and horizontal trim pieces, the at least one panel having opposite horizontal edges secured within the horizontal trim piece undercuts of spaced-apart horizontal trim pieces and further having opposite vertical edges secured within the vertical trim piece undercuts of the spaced-apart vertical trim pieces;

wherein the at least one panel is clamped and retained on the overhead garage door without itself being installed on the overhead garage door so as to float within the respective vertical and horizontal trim piece undercuts, thereby reducing material costs and mitigating against adverse thermal expansion effects on the overhead garage door trim system.

15. A method of employing an overhead garage door trim system on an overhead garage door having a plurality of sections, the method comprising the steps of:

positioning an at least one panel on and abutting an at least one section of the plurality of sections of the overhead garage door; and installing trim pieces spaced-apart along the at least one section of the overhead garage door adjacent to the at least one panel with respective trim piece inner edges opposed and respective inwardly-facing trim piece undercuts formed along the trim piece inner edges securing the at least one panel along respective panel edges;

wherein the at least one panel is clamped and retained on the overhead garage door without itself being installed on the overhead garage door so as to float within the respective trim piece undercuts, thereby reducing material costs and mitigating against adverse thermal expansion effects on the overhead garage door trim system.

16. The method of claim 15 further comprising the step of selecting the at least one panel from the group consisting of a window-looking panel, a window frame-looking panel, and a wood-looking panel.

17. The method of claim 15 wherein the step of positioning the at least one panel involves overlying an outer panel on an inner panel.

18. The method of claim 17 wherein the step of overlying an outer panel on an inner panel includes selecting a window-looking panel as the inner panel and selecting a window frame-looking panel as the outer panel.

19. The method of claim 15 wherein the step of installing the trim pieces includes adhering the trim piece inner surface of the respective trim piece onto the at least one section of the overhead garage door.

20. The method of claim 15 wherein the step of installing the trim pieces includes installing at least one horizontal trim piece of the trim pieces spanning a width of the at least one section of the overhead garage door.

21. The method of claim 20 wherein the step of installing the trim pieces includes installing two spaced-apart horizontal trim pieces of the trim pieces each spanning a width of the at least one section of the overhead garage door.

22. The method of claim 21 further comprising:

sequentially sliding each of the at least one panels between the spaced-apart horizontal trim pieces so as to be secured horizontally by the respective horizontal trim piece undercuts; and installing a vertical trim piece of the trim pieces adjacent to each of the at least one panels in sequence, wherein a first vertical trim piece of the trim pieces is installed spanning the spaced-apart horizontal trim pieces, a first panel of the at least one panel is slid between the spaced-apart horizontal trim pieces until the first panel abuts the first vertical trim piece, a second vertical trim piece of the trim pieces is installed spanning the spaced-apart horizontal trim pieces also abutting the first panel opposite the first vertical trim piece, and a second panel of the at least one panel is slid between the spaced-apart horizontal trim pieces until the second panel abuts the second vertical trim piece.

23. The method of claim 15 wherein the step of installing the trim pieces includes installing at least one vertical trim piece of the trim pieces having opposite vertical trim piece undercuts to secure respective vertical edges of two adjacent panels of the at least one panel.

24. The method of claim 15 wherein the step of installing the trim pieces involves engaging inner surfaces of the trim pieces with raised panel features on the at least one section of the overhead garage door.

* * * * *